US010183381B2

(12) United States Patent
Li

(10) Patent No.: US 10,183,381 B2
(45) Date of Patent: Jan. 22, 2019

(54) WRENCH

(71) Applicant: Yi-Min Li, Taichung (TW)

(72) Inventor: Yi-Min Li, Taichung (TW)

( * ) Notice: Subject to any disclaimer, the term of this patent is extended or adjusted under 35 U.S.C. 154(b) by 84 days.

(21) Appl. No.: 15/361,059

(22) Filed: Nov. 24, 2016

(65) Prior Publication Data

US 2018/0141191 A1 May 24, 2018

(51) Int. Cl.

| | |
|---|---|
| ***B25B 23/10*** | (2006.01) |
| ***B25B 13/08*** | (2006.01) |
| ***B25B 13/06*** | (2006.01) |
| ***B25B 13/46*** | (2006.01) |
| ***B25B 13/04*** | (2006.01) |
| ***B25B 23/00*** | (2006.01) |

(52) U.S. Cl.

CPC ..... *B25B 13/08* (2013.01); *B25B 13/04* (2013.01); *B25B 13/461* (2013.01); *B25B 23/0071* (2013.01)

(58) Field of Classification Search

CPC ..... B25B 23/10; B25B 13/06; B25B 13/08; B25B 13/04; B25B 13/461; B25B 23/0071

USPC ..... 81/125

See application file for complete search history.

(56) References Cited

U.S. PATENT DOCUMENTS

| | | | | |
|---|---|---|---|---|
| 1,550,436 | A * | 8/1925 | Hall | B25B 13/08 81/119 |
| 2,697,371 | A * | 12/1954 | Bowman | B25B 13/08 81/125 |
| 3,009,372 | A * | 11/1961 | Kostka | B25B 13/462 81/58.4 |
| 3,142,211 | A * | 7/1964 | Faso | B25B 23/108 81/125 |
| 4,787,273 | A * | 11/1988 | Griffith | B25B 13/04 81/125 |
| 6,732,616 | B2 * | 5/2004 | Lin | B25B 23/0071 81/119 |
| 8,601,915 | B1 * | 12/2013 | Garvey | B25B 23/0071 81/180.1 |
| 2007/0056411 | A1 * | 3/2007 | Carlson | B25B 13/04 81/125 |

* cited by examiner

*Primary Examiner* — Hadi Shakeri

(57) ABSTRACT

A wrench has a socket and a driving structure, and the socket accepts the driving structure. The driving structure has a first end and a second end and a slidable cover. The slidable cover has a main body adjacent to and outside of the socket for limiting movement of the main body between a locking position and an open position on the wrench. When the main body is in the locking position, the main body covers the first end of the driving structure, a threaded member passes through the second end of the driving structure into the socket and is stopped by the main body without exceeding the socket of the wrench; and when the main body is in the open position, the main body exits the first end of the driving structure, the threaded member passes through the first end of the driving structure and exceeds the socket of the wrench.

7 Claims, 5 Drawing Sheets

WRENCH

BACKGROUND OF THE INVENTION

Field of the Invention

The present invention relates to a wrench, and more particularly to a wrench capable of prevent a threaded member from exceeding.

Description of the Related Art

With various range of wrenches, such as the open wrench, hex wrench and so on. The wrench usually has a socket which is driven by a driving structure. The driving structure has a first end and a second end and performs a locking or unscrewing operation on a threaded member such as a screw or a nut.

The nut is a ring and has six sides, and the screw has a threaded section projecting from a bottom surface of a hex head. However, whether nut or screw with a hexagon head, may disengage the driving structure of the socket and interrupt the transmission of the torque so that the wrench no longer performs locking or unscrewing operations.

For example, the wrench has two jaws that are designed to be integral with the socket. The driving structure is a U-shaped opening formed between the claws and the socket. Thus, the U-shaped opening has an outlet and an inlet end through the socket.

During locking or unscrewing operations, the claws are placed two opposite sides to the hexagon head, transferring the torque of the wrench to the threaded member, and loosening the threaded section into a workpiece. The hexagon head is free the socket or the claw, interrupting the transmission of the torque of the wrench and no longer performing locking or unscrewing operations.

Another example, the driving structure of the hex wrench has a through hole. The inner wall of the hole is a number of continuous teeth that can engage with the hexagon head of a nut or screw, but can not prevent the hex head of a nut or screw from exceeding the socket of the wrench. Therefore, the hex wrench also have the torque transmission interruption problems.

In order to solve this problem, the socket is usually pressed with the palm of a user's hand, thereby blocking the first end of the driving structure. Although the threaded member is blocked by the palm, avoid the hex head from exceeding the wrench's socket. But the wrench of the socket will be the pressure of the palm of your hand, but easy to drop to the surface of the workpiece to lift the driving structure and nut or screw hexagonal head meshing relationship can not effectively solve the shortcomings of torque transmission interruption.

Therefore, it is desirable to provide a multipurpose stand for an improved wrench to mitigate and/or obviate the aforementioned problems.

SUMMARY OF THE INVENTION

An objective of the present invention is to provide a wrench capable of prevent a threaded member from exceeding.

In order to achieve the above mentioned objective, a wrench has a socket and a driving structure, and the socket accepts the driving structure. The driving structure has a first end and a second end and a slidable cover. The slidable cover has a main body adjacent to and outside of the socket for limiting movement of the main body between a locking position and an open position on the wrench. When the main body is in the locking position, the main body covers the first end of the driving structure, a threaded member passes through the second end of the driving structure into the socket and is stopped by the main body without exceeding the socket of the wrench; and when the main body is in the open position, the main body exits the first end of the driving structure, the threaded member passes through the first end of the driving structure and exceeds the socket of the wrench.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
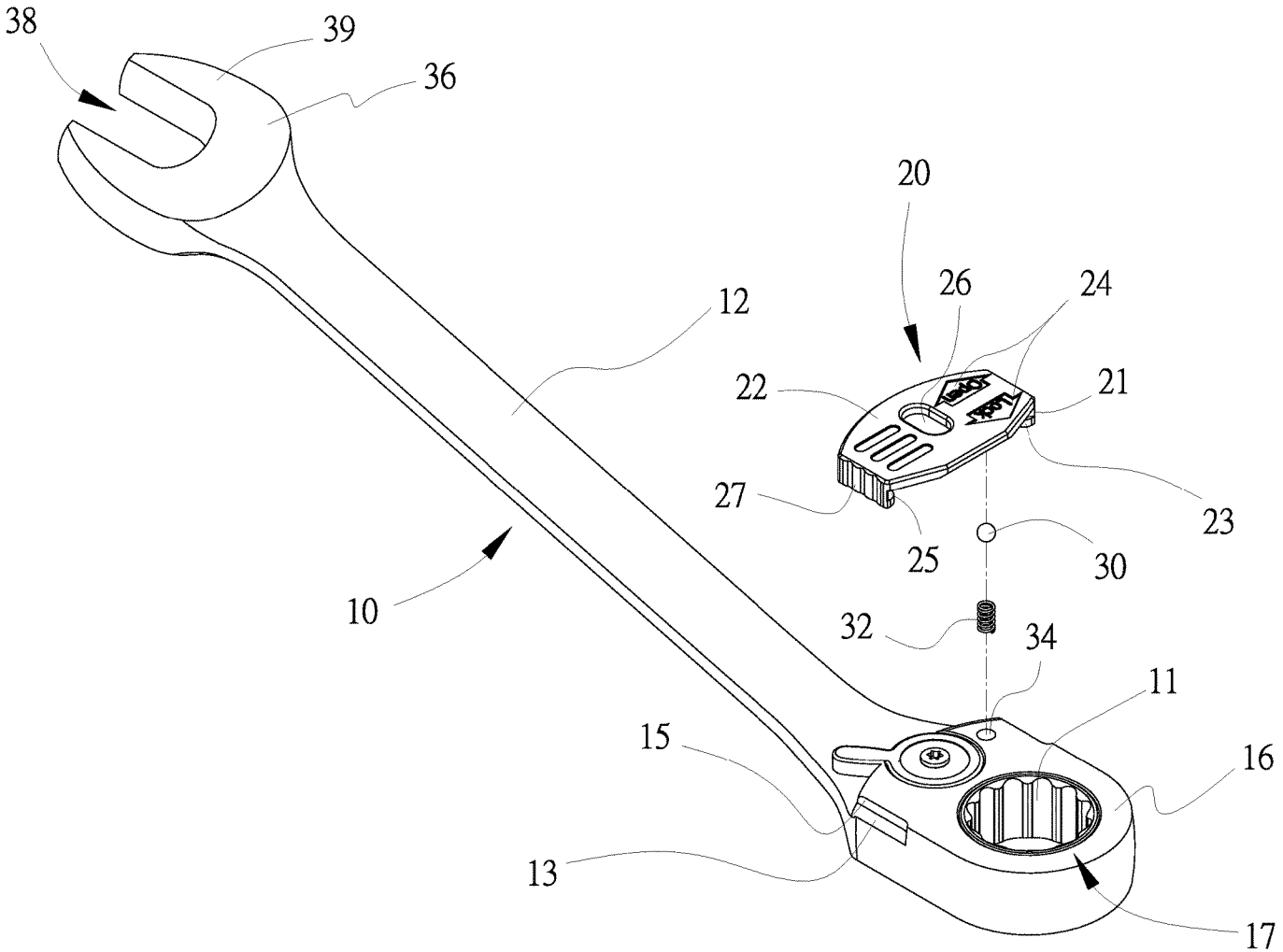
FIG. 1 is a local detailed drawing of a first embodiment according to the present invention.

Please refer to FIG. 1. In a first embodiment, a wrench 10 is coupled with a slidable cover 20.

The wrench 10 has a handle 12, and two ends of the handle 12 is respectively connected to a socket 16 and an open socket 36. In this embodiment, the handle 12, the socket 16 and the open socket 36 are integral together. Alternatively, the socket 16 and the open socket 36 are pivoted on to the handle 12.

Figure 4:
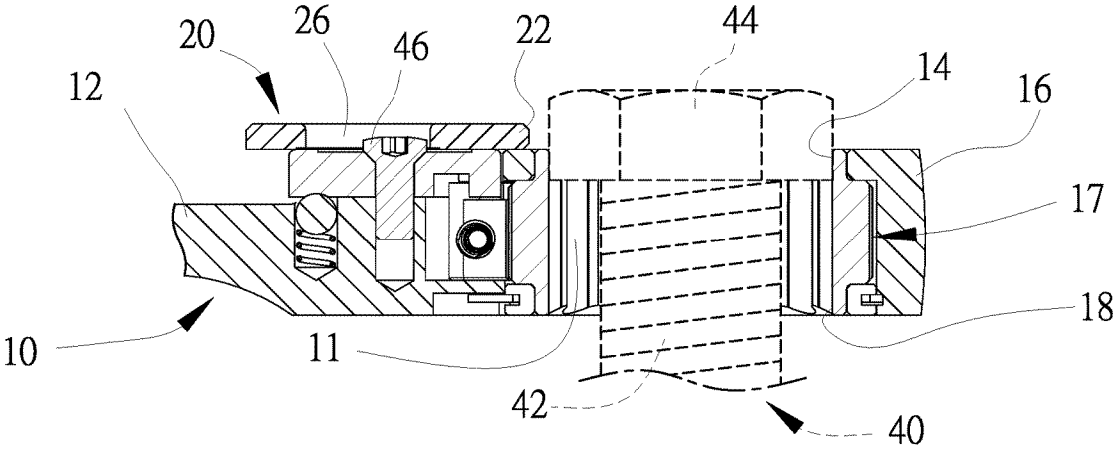
FIGS. 4 and 5 are schematic drawings of continuous movements of the slidable cover.
Figure 5:
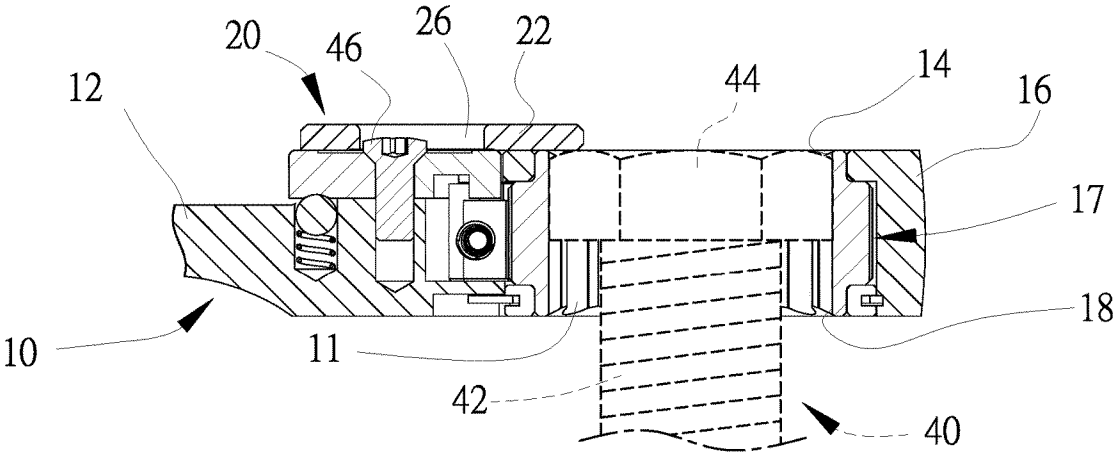

The wrench 10 further has two limiting slots 13, two tracks 15 and a first recess 34, and the limiting slots 13 are disposed an outside of the socket 16. The tracks 15 are disposed at two sides of the socket 16, and each track 15 and limiting slot 13 are parallel with each other. The first recess 34 disposed on socket 16 faces the slidable cover 20 and accepts a ball 30 and a spring 32 together. The ball 30 is pushable partially out of the socket 16 of the wrench 10 by the spring 32 (as shown in FIGS. 4 and 5).

The socket 16 accepts a driving structure 17. In this embodiment, the driving structure 17 is a hollow sleeve and has teeth disposed on its inner circumference and a toothed hole 11 at a center of the socket 16. The driving structure 17 has a first end 14 and a second end 18 (as shown in FIGS. 4 and 5).

The open socket 36 further has two claws 39 at two opposite sides which surrounds the opening 38.

Figure 2:
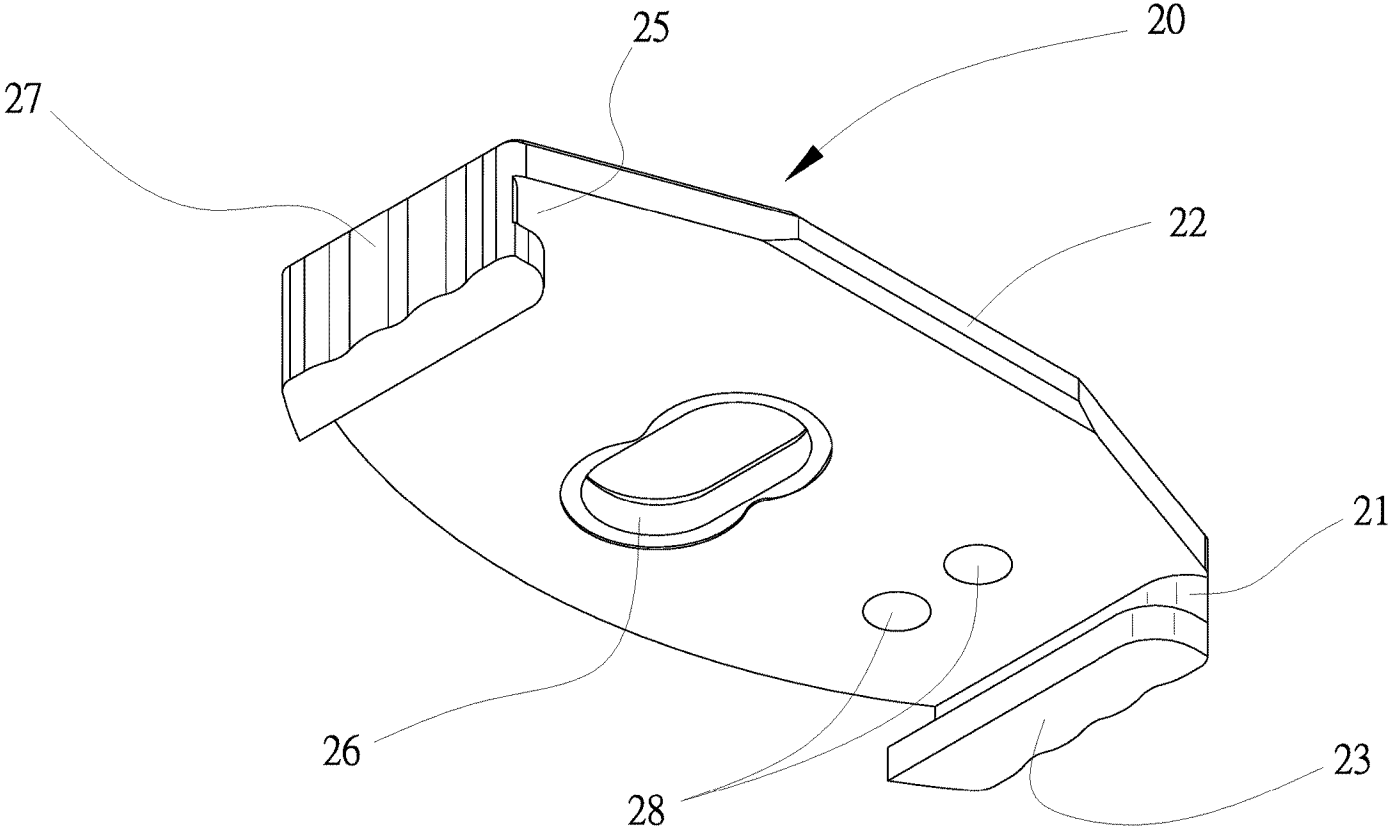
FIG. 2 is a perspective drawing of a slidable cover of the first embodiment according to the present invention.
Figure 3:
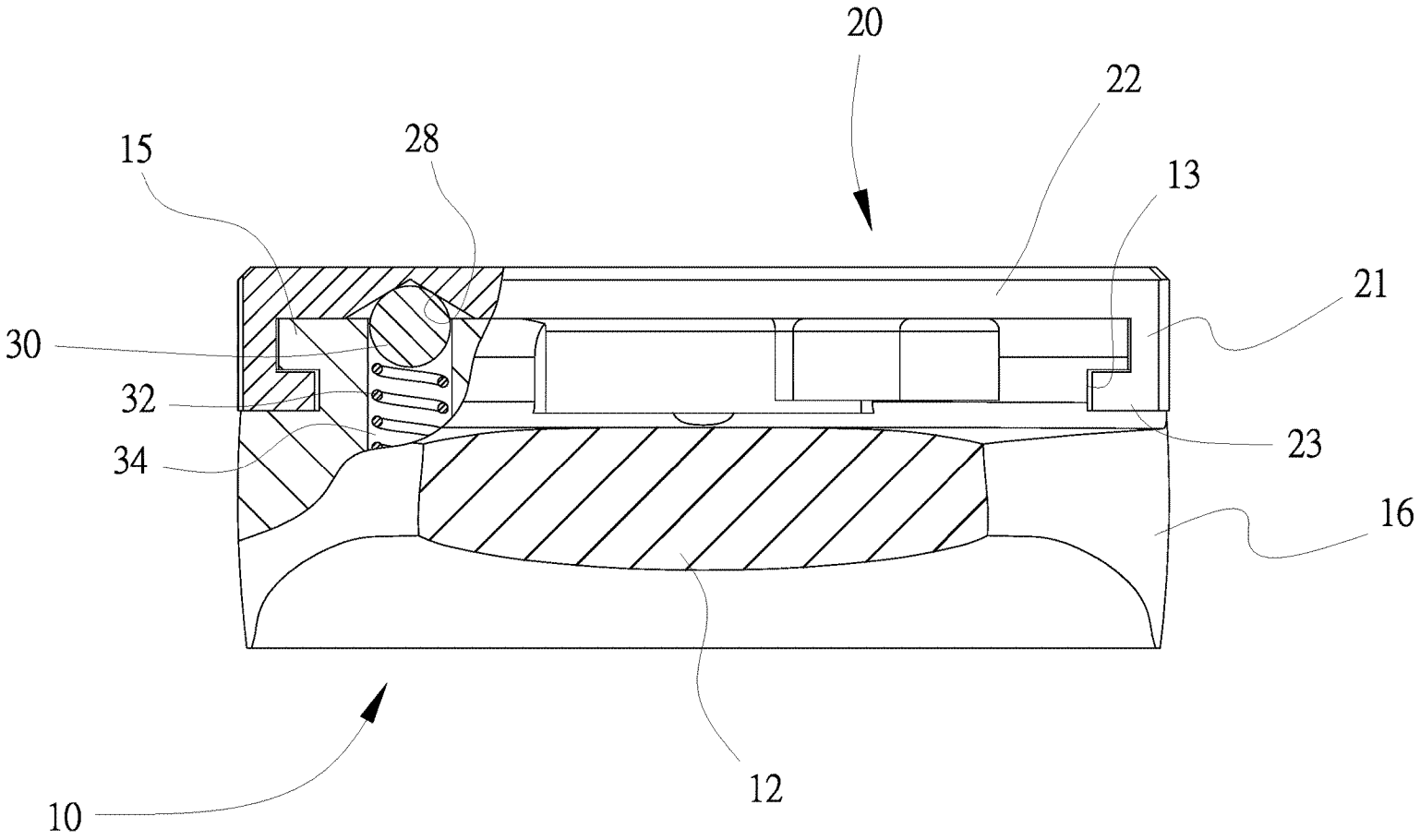
FIG. 3 is a cross-sectional drawing of the slidable cover and the wrench of the first embodiment according to the present invention.

As shown in FIGS. 1-3, the slidable cover 20 has a main body 22, two side portions 21, two bottom portions 23 and two grooves 25. The main body 22 has a marking area 24 and two second recesses 28 and each second recess 28 is disposed on the main body 22 facing the socket 16 and accepts the ball 30 to poisition the slidable cover 20. The slidable cover 20 further comprises a through aperture 26.

In this embodiment, the marking area 24 is shown with arrow signs and English letters and disposed on a different side of the main body 22 than the second recess 28. In other embodiments, the marking area might display letters, number, symbols, or signs.

Two side portions 21 are respectively disposed on two sides of the main body 22, and each side portion 21 is provided with an anti-slip surface 27. The two bottom portions 23 face each other and the bottom portion 23 and the connected side portions 21 are integral with each other. The groove 25 is disposed between the main body 22 and the bottom portion 23.

When the bottom portion 23 is in the limiting slot 13, the tracks 15 are disposed in the grooves 25 and parallel with the bottom portions 23, and the side portions 21 press against the tracks 15 and support linear movement of the main body 22 between a locking position and an open position corresponding to the socket 16 of the wrench 10. In this embodiment, one end of the limiting slot 13 is closed which limits the linear movement of the main body 22.

As shown in FIG. 5, at the locking position, the main body 22 covers partial of the first end 14 of the driving structure 17.

The hexagonal head 44 of the threaded member 40 enters the socket 16 through the second end 18 of the driving structure 17 but is blocked by the main body 22 partially so that the hexagonal head 44 engages with the toothed hole 11 without the hexagonal head 44 exceeds beyond the socket 16. Therefore, the threaded member 40 is free from being loosen even if the wrench 10 is not pressed by the palm of the hand, so locking or unscrewing procedure of the threaded section 42 is more smoothly than the conventional wrench.

As shown in FIG. 4, the main body 22 leaves the first end 14 of the driving structure 17 at the open position, and no longer blocks the threaded member 40. The threaded member 40 can still exceed the socket 16 through the first end 14 of the driving structure 17.

The through aperture 26 of the slidable cover 20 avoids a screw 46 locked to the socket 16 to prevent the slidable cover 20 from unnecessary interference with either the locking position or the open position. Also, the marking area 24 (see FIG. 1) clearly indicates whether the slidable cover 20 is at the locking or the open position.

Figure 6:
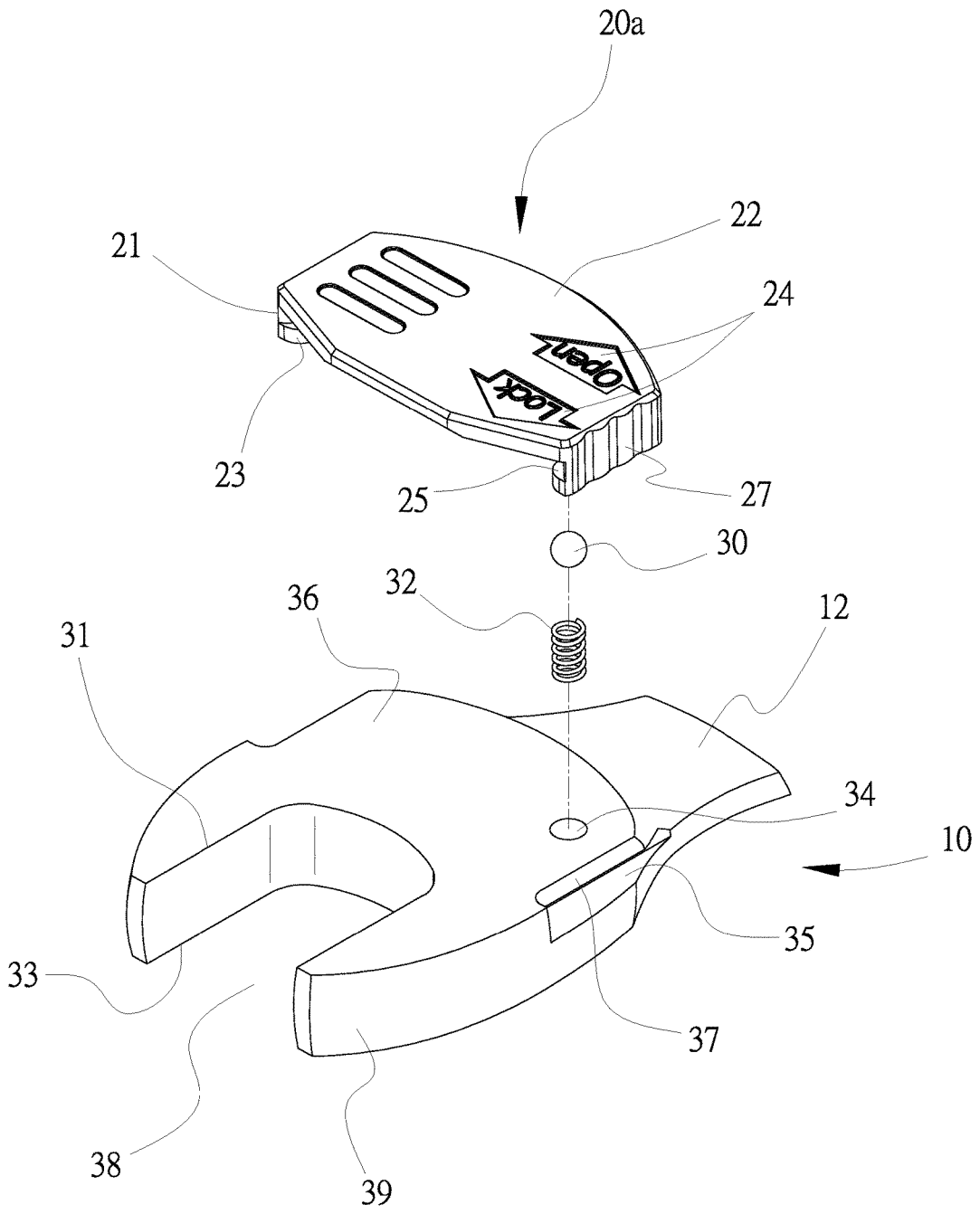
FIG. 6 is a local detailed drawing of a second embodiment according to the present invention.

FIG. 6 is a second embodiment of the wrench 10, and its construction is substantially the same as that of the first embodiment. However, there is no through-aperture. In addition, there is another slidable covers than that of the first embodiment and is defined as the second slidable cover 20*a*. Therefore, the elastic combination of the ball 30 and the spring 32 disposed in the first recess 34 formed in the open socket portion 36 is configured to effect the positioning of the second slidable cover 20*a*. Meanwhile, a new limiting slot 35 is respectively formed on each side of the open-ended socket 36, to receive the bottom portion 23 of the second slidable cover 20*a* and to place the new track 37 into the groove 25 of the second the slidable cover 20*a*.

Thus, at the open position, the second slidable cover 20*a* is away from the first end 31 of the opening 38. At the locking position, the second the slidable cover 20*a* can cover partial of the first end 31 to prevent the threaded member from exceeding the open socket 36.

Although the present invention has been explained in relation to its preferred embodiment, it is to be understood that many other possible modifications and variations can be made without departing from the spirit and scope of the invention as hereinafter claimed.

What is claimed is:

1. An improved tool comprising:

a wrench having a socket and a driving structure, the socket accepting the driving structure, the driving structure having a first end and a second end;

wherein the socket further comprises two limiting slots made in an external face thereof and two tracks provided on two sides thereof, with the tracks extending parallel to the limiting slots; and a slidable cover having a main body adjacent to and outside of the socket for limiting movement of the main body between a locking position and an open position on the wrench, two side portions on the main body, two bottom portions facing each other and respectively connected to the side portions, and two grooves each of which is located between the main body and one of the bottom portions, wherein each of the bottom portions is integral with one of the side portions;

wherein when the main body is in the locking position, the main body covers the first end of the driving structure, a threaded member passes through the second end of the driving structure into the socket and is stopped by the main body without exceeding the socket of the wrench; and when the main body is in the open position, the main body exits the first end of the driving structure, the threaded member passes through the first end of the driving structure and exceeds the socket of the wrench.

2. The improved tool as claimed in claim 1, wherein when the bottom portion is in the limiting slot of the wrench, the tracks are disposed in the grooves and parallel with the bottom portions, and the side portions press against the tracks and support linear movement of the main body corresponding to the wrench.

3. The improved tool as claimed in claim 2, wherein the main body further comprises a marking area disposed on a different side of the main body than the second recess.

4. The improved tool as claimed in claim 3, wherein the marking area displays letters, number, symbols, or signs.

5. The improved tool as claimed in claim 1, wherein the side portions are further provided with an anti-slip surface.

6. The improved tool as claimed in claim 1 further comprising:

a first recess disposed on the socket facing the main body;

a ball and a spring disposed in the first recess of the wrench, the ball pushable partially out of the socket of the wrench by the spring; and a plurality of second recesses disposed on the main body, each second recess facing the socket of the wrench and the ball pressing against a corresponding second recess to position the slidable cover.

7. The improved tool as claimed in claim 1, wherein the slidable cover further comprises a through aperture disposed on the main body.

* * * * *